US007325709B2

(12) United States Patent
Ishizawa et al.

(10) Patent No.: US 7,325,709 B2
(45) Date of Patent: Feb. 5, 2008

(54) FASTENER DRIVING TOOL AND MAGAZINE DEVICE

(75) Inventors: Yoshinori Ishizawa, Hitachinaka (JP); Hiroki Kitagawa, Hitachinaka (JP); Masashi Nishida, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 113 days.

(21) Appl. No.: 11/078,476

(22) Filed: Mar. 14, 2005

(65) Prior Publication Data

US 2005/0211745 A1 Sep. 29, 2005

(30) Foreign Application Priority Data

Mar. 29, 2004 (JP) ..... P2004-094190

(51) Int. Cl.
*B25C 1/04* (2006.01)

(52) U.S. Cl. ..... 227/120; 227/119; 227/139; 227/147

(58) Field of Classification Search ..... 227/120, 227/119, 139, 147, 150
See application file for complete search history.

(56) References Cited

U.S. PATENT DOCUMENTS

| | | | | |
|---|---|---|---|---|
| 3,980,179 | A * | 9/1976 | Schrepferman | 206/338 |
| 4,524,896 | A * | 6/1985 | Morrell, Jr. | 227/126 |
| 5,816,469 | A | 10/1998 | Ohuchi | |
| 6,053,389 | A * | 4/2000 | Chu et al. | 227/120 |
| 6,296,167 | B1 | 10/2001 | Jen | |
| 6,431,428 | B1 | 8/2002 | Chen | |
| 6,609,646 | B2 * | 8/2003 | Miller et al. | 227/8 |
| 6,641,022 | B2 * | 11/2003 | Hamano et al. | 227/120 |
| 6,729,524 | B1 * | 5/2004 | Yao | 227/120 |
| 7,025,242 | B1 * | 4/2006 | Schnell | 227/120 |

FOREIGN PATENT DOCUMENTS

| | | |
|---|---|---|
| CN | 2 086 190 | 10/1991 |
| CN | 2442797 | 10/2000 |
| EP | 1 118 435 | 7/2001 |
| JP | 1-222872 | 9/1989 |
| JP | 2001-277149 | 10/2001 |
| JP | 2002-066949 | 3/2002 |

* cited by examiner

*Primary Examiner*—Brian D. Nash
(74) *Attorney, Agent, or Firm*—Antonelli, Terry, Stout & Kraus, LLP.

(57) ABSTRACT

A fastener driving tool having a magazine device including a magazine and a nail feeder. The magazine extends in a first direction and defines an accommodation portion for accommodating therein a fastener array. Each fastener has a shaft with a sharp-end and a head connected to the shaft. The plurality of fasteners are directed in a second direction perpendicular to the first direction and positioned side by side to form the fastener array extending in the first direction. The magazine has one end and another end in the second direction. One end is close to the sharp end of the fastener and another end is close to the head of the fastener. The accommodation portion includes an expanding portion having a width in a third direction perpendicular to the first direction and to the second direction. The width is gradually increased from the one end toward the other end.

18 Claims, 7 Drawing Sheets

FASTENER DRIVING TOOL AND MAGAZINE DEVICE

BACKGROUND OF THE INVENTION

The present invention relates to a fastener driving tool such as a nail gun and, more particularly, to a fastener driving tool provided with a highly rigid and light-weight magazine.

In a conventional fastener driving tool such as a nail gun, reciprocal motion of a piston is transferred to a driver blade that moves along a nose portion of the nail gun, and a nail supplied to the nose portion is struck by the driver blade to drive the nail into a workpiece such as a piece of wood. To successively supply the nails to the nose portion, the nails are closely positioned side by side and connected to each other to form an array by using a resin or the like. The nail array is inserted into a magazine fixed to the nail gun. The nail array is urged toward the nose portion by a nail feeder provided in the magazine. The provision of a magazine enhances portability and utility of the nail gun.

Various magazine devices each including a magazine and a nail feeder have been proposed to accurately and reliably supply nails accommodated in the magazine to the nose portion as disclosed in laid open Japanese Patent Application publication Nos. H01-222872, 2002-66949 and 2001-277149.

The magazine devices disclosed in these publications are configured to hold the nails by a casing of a magazine itself, or components provided in the magazine casing. The shape of the casing of the conventional magazine 122 is shown in FIG. 11. The shape is in conformance with the shape of the nails held therein.

SUMMARY OF THE INVENTION

The present inventors realized the inherent problems in the conventional fastener driving tool. Because the shape of the magazine casing is in conformance with the shape of the nails, the casing is relatively thin in a direction perpendicular to an axis of the fasteners. Thus the ratio of the length in the perpendicular direction to the length in the axial direction is small. This leads to a problem in that the magazine readily flexes and bends in the direction perpendicular to the axis of the fasteners. This may cause the fasteners to come into contact with an inner surface of the casing when the entire magazine flexes, even while fasteners are held within the magazine. Accordingly, reliable supply of fasteners to the nose portion may be degraded.

To solve this problem, thick magazine casing is conceivable to enhance rigidity. However, this would make the magazine heavier and, as a result, destroy the portability thereof.

Further, in a large fastener driving tool with an increased fastener storage capacity, the user cannot hold the fastener driving tool reliably with just one hand on the handle portion which is a grasping section. In such a case, the user may have to use the other hand to hold the magazine that extends outward in the vicinity of the handle portion. With such a conventional magazine that follows the shape of the fasteners, angulated corners are provided. Therefore, it is difficult to hold the magazine by hand. This presents a particularly obvious problem for people with small hands.

It is therefore, an object of the present invention to provide a fastener driving tool provided with a light weight magazine device having sufficient rigidity and facilitating hand-holding.

This and other object of the present invention will be attained by a fastener driving tool including a frame, a nose portion, a driver blade, a handle portion, and a magazine device provided with a magazine and a nail feeder. The nose portion extends outward from the frame for contacting a workpiece. The nose portion is formed with an ejection passage. The driver blade is reciprocally movable within the ejection passage. The handle portion extends outward from the frame and provides a grasping portion. The magazine device bridges between the nose portion and the handle portion for supplying fasteners to a position of the ejection passage. In the magazine, the magazine has one end and another end in a moving direction of the driver blade, and defines an accommodation portion for accommodating therein a fastener array. Each fastener has a shaft with a sharp-end and a head connected to the shaft. A plurality of fasteners are directed in parallel with the moving direction of the driver blade in the magazine and are positioned side by side to form the fastener array. The accommodation portion includes an expanding portion having a width in a direction perpendicular to the shaft of the fastener and to the fastener array. The width is gradually increased from the one end close to the sharp end of the fastener toward the other end close to the head of the fastener. The nail feeder is disposed in the magazine for urging the fastener array toward the ejection passage.

In another aspect of the invention, there is provided a magazine device including a magazine and a nail feeder. The magazine extends in a first direction and defines an accommodation portion for accommodating therein a fastener array. Each fastener has a shaft with a sharp-end and a head connected to the shaft. A plurality of fasteners are directed in a second direction perpendicular to the first direction and are positioned side by side to form the fastener array extending in the first direction. The magazine has one end and another end in the second direction. One end is close to the sharp end of the fastener and the other end is close to the head of the fastener. The accommodation portion includes an expanding portion having a width in a third direction perpendicular to the first direction and to the second direction, and the width is gradually increased from the one end toward the other end. The nail feeder is disposed in the magazine for urging the fastener array in the first direction.

BRIEF DESCRIPTION OF DRAWINGS

In the drawings;

FIG. 6(*b*) is a cross-sectional view of a part of a magazine in a conventional fastener driving tool for the purpose of comparison with the structure shown in FIG. 6(*a*);

DETAILED DESCRIPTION OF PREFERRED EMBODIMENTS

Figure 1:
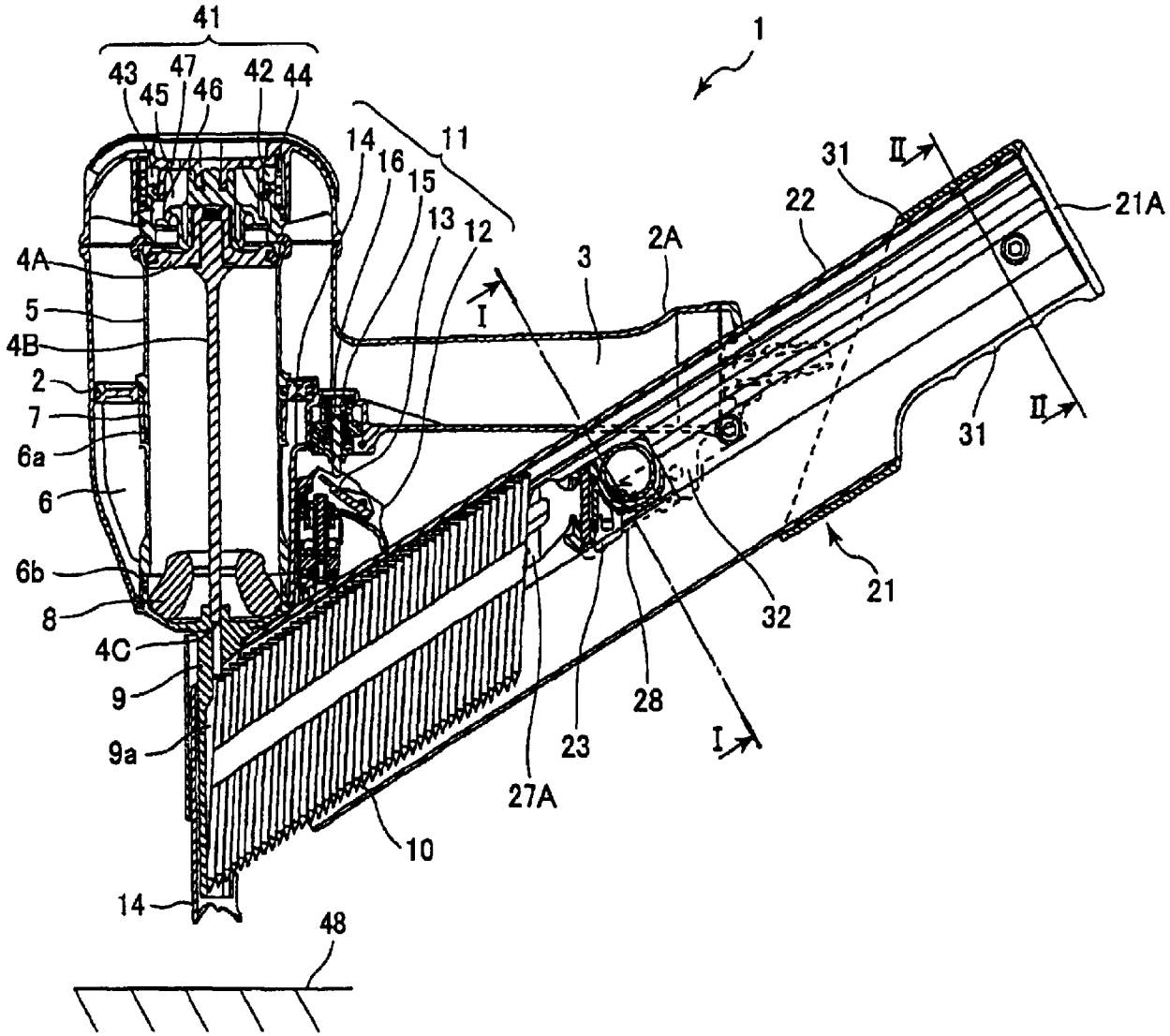
FIG. 1 is a vertical cross-sectional view of a nail gun according to an embodiment of the present invention.

A fastener driving tool according to an embodiment of the present invention will now be described with reference to FIGS. 1 to 7. The first embodiment pertains to a nail gun 1 which employs compressed air as a power source to drive nails. The nail gun 1 includes a frame 2, a handle 2A located at one end of the frame 2, and a nose 9 located at a lower end of the frame 2. The frame 2, the handle 2A and the nose 9 are provided integrally. Within the nose 9 is formed an ejection aperture 9*a* that is a space through which nails 10 are supplied and in which a driver blade 4B (described later) slides reciprocally. An accumulator 3 is defined within the handle 2A and the frame 2 for accumulating therein compressed air supplied from a compressor (not shown). The accumulator 3 is connected to the compressor by an air hose (not shown). A cylinder 5 is disposed within the frame 2. A piston 4A is disposed within the cylinder 5. The piston 4A is reciprocally slidably movable relative to the cylinder in an axial direction thereof. The driver blade 4B is connected integrally with the piston 4A. The driver blade 4B has a tip end 4C to which the nail is abuttable.

A return chamber 6 is provided on a lower outer periphery of the cylinder 5 for saving compressed air in order to return the piston 4A to its top dead center. An air passageway 6*a* is formed in an axially intermediate portion of the cylinder 5, and a check valve 7 is provided to cover the air passageway 6*a*. The check valve 7 allows air to flow only in one direction from within the cylinder 5 into the return chamber 6. Another air passageway 6*b* in continuous communication with the return chamber 6 is formed at the lower end portion of the cylinder 5. Further, a piston bumper 8 is provided at the lower end of the cylinder 5 for absorbing excess energy of the piston 4A after one of the nails 10 has been driven.

An operating portion 11 is provided in a base portion of the handle 2A, and includes a trigger 12, an arm plate 13, a push lever 14, a trigger valve section 15, and a plunger 16. The trigger 12 is adapted to be operated by a user. The arm plate 13 is pivotally supported to the trigger 12. The push lever 14 protrudes from the lower edge of the nose 9, and extends to the vicinity of the arm plate 13. The push lever 14 is normally biased to move away from the frame 2 (towards the nose 9 side). The trigger valve section 15 functions as a change-over valve for supplying and exhausting compressed air to and from a main valve unit 41 (described later). The plunger 16 is adapted for transmitting the movement of the arm plate 13 to the trigger valve section 15.

As is well known, by pulling the trigger 12 and pressing the push lever 14 against a workpiece 48, the plunger 16 of the trigger valve section 15 is urged to be moved by way of a linking mechanism between the arm plate 13 and the trigger 12.

A magazine device 21 functioning as a nail ejection portion is in communication with the nose 9. The magazine device 21 includes a magazine 22, filled with the nails 10, and a nail feeder 23 for sequentially supplying the nails 10 in the magazine 22 to the ejection aperture 9*a*. The nail feeder 23 includes a pawl 27A that presses the nails 10 and a main feeder unit 28 that acts as a casing for the nail feeder 23.

An end section 21A (FIG. 1) on the handle 2A side of the magazine device 21 is formed to be narrower than the remaining section of the magazine device 21. At the narrowing end section 21A, a grasping section 31 having substantially finger-shaped indentations is provided in the vicinity of a gap 22*f* (FIG. 3) and a guide groove portion 22C (FIGS. 2 and 3), which will be described later. The nail feeder 23 is supported at one vertical side wall of the magazine 22, and a handle arm 32 (FIG. 1) is supported at another vertical side wall of the magazine 22. The handle arm 32 serves as an attachment component for connecting the magazine 22 to the handle 2A.

The main valve unit 41 is provided around the outer periphery of the upper side of the cylinder 5 as shown in FIG. 1. The main valve unit 41 includes a main valve 42, a main valve chamber section defining therein a main valve chamber 43, a main valve spring 44, and an exhaust rubber 46. The main valve chamber 43 houses therein the main valve 42. The main valve 42 is movable in an axial direction of the cylinder 5. The main valve spring 44 is adapted to urge the main valve 42 towards its bottom dead center. An air passageway 45 is defined having one end in communication with a cylinder space above the piston 4A and another end in communication with an atmosphere for discharging compressed air in the cylinder space above the piston 4A to the atmosphere. The exhaust rubber 46 is disposed to selectively contact the main valve 42 in response to the reciprocal movement of the main valve 42 in order to selectively shut off the air passageway 45. The frame 2 has an upper end formed with an exhaust vent 47 to which the other end of the air passageway 45 is connected.

Figure 2:
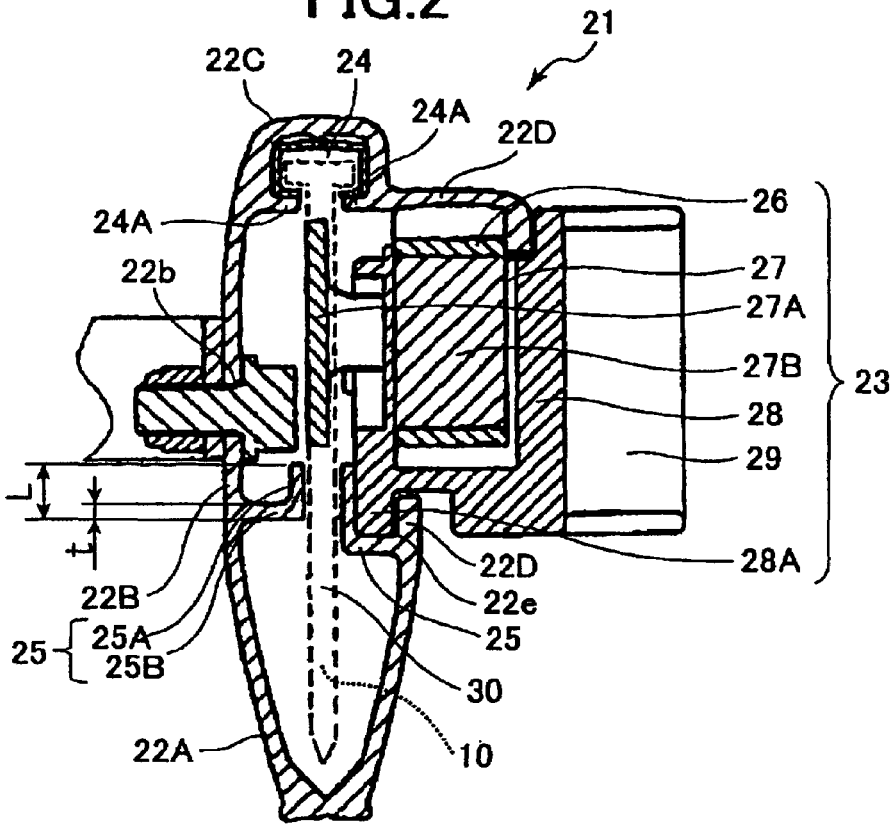
FIG. 2 is a cross-sectional view taken along the line I-I in FIG. 1.
Figure 3:
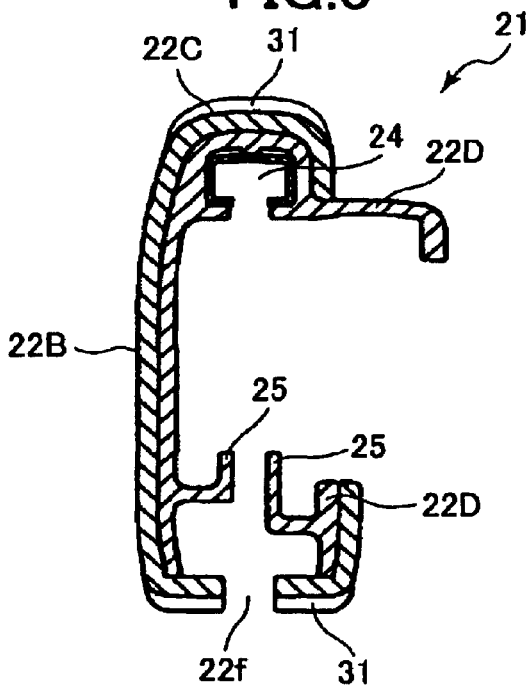
FIG. 3 is a cross-sectional view taken along the line II-II in FIG. 1.

An essential portion of the magazine device 21 is shown in FIG. 2. This portion is near the connecting region between the magazine 22 and the handle 2A. The magazine 22 is made from a soft non-ferrous metal such as aluminum and magnesium, and is produced by extrusion molding into a shape such that the casing thereof covers the nails 10.

The magazine 22 includes an expanding portion 22A having two opposing walls in such a manner that a distance between the walls is gradually increased from a location at the sharp end side of the nails 10 toward the heads of the nails 10. The opposing walls are configured into arcuate shape in cross-section. A flat surface portion 22B having a substantially flat-surface shape is provided in continuous fashion with the expanding portion 22A. The flat surface portion 22B is formed with a bolt hole 22*b* allowing a bolt to pass therethrough for fixing the magazine device 21 to the handle 2A.

A feeder fixing portion 22D continuous with the expanding portion 22A is provided at a location opposite to the flat surface portion 22B. Thus, the nail feeder 23 is attached to the feeder fixing portion 22D. The guide groove portion 22C defines therein a guide groove 24 extending between the flat surface portion 22B and the feeder fixing portion 22D. Thus, the heads of the nails 10 is supported in the guide groove 24.

Figure 6A:
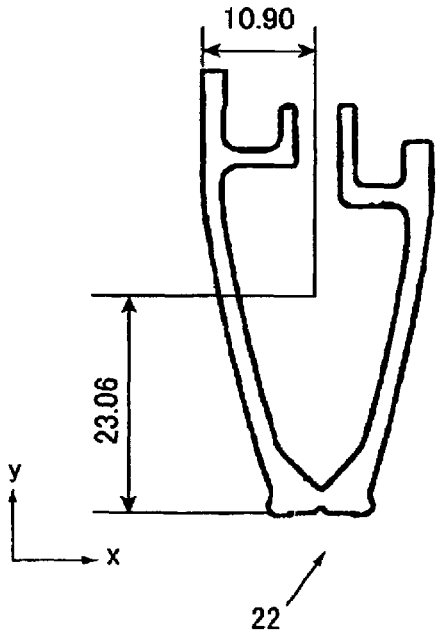
FIG. 6(*a*) is a cross-sectional view of a part of a magazine in the nail gun according to the embodiment.
Figure 6B:
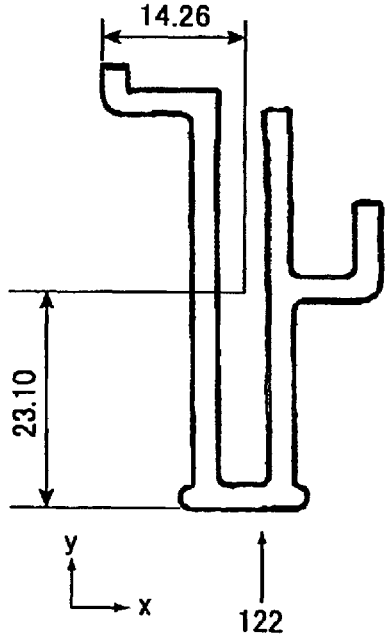

With such a cross-sectional arrangement of the magazine 22, modulus of section of the magazine 22 can be increased in a directions perpendicular to the axial direction of the fastener 10 (in a widthwise direction of the magazine 22, see x in FIG. 6(*a*)). Therefore, mechanical strength or rigidity is increased in the direction. Thus bending strength and distorsional strength of the entire magazine can be increased. Further, since the magazine 22 includes the curved region, easy holdability can result.

As best shown in FIG. 2, the guide groove 24 has substantially C-shape cross-section having protrusions 24A protruding from the flat surface portion 22B and the feeder fixing portion 22D. Since the heads of the nails 10 are slidingly movably supported by the protrusions 24A, the nails 10 can be held within the guide groove 24 without releasing from the guide groove 24.

A pair of guide portions 25 are positioned in confrontation with each other. Each guide portion 25 extends toward a shaft part of the nail 10. One guide portion 25 protrudes from the vicinity of the boundary between the expanding portion 22A and the flat surface portion 22B, and the other guide portion 25 protrudes from the vicinity of the boundary between the expanding portion 22A and the feeder fixer portion 22D. Each of the guide portions 25 includes a guide wall 25A and protruding portion 25B. Each guide wall 25A has a vertical guide surface extending in parallel with the nail 10 so that shafts of the nails 10 are in slide contact with the guide surface. The protruding portion 25B supports the guide wall 25A so that the guide wall 25A can support the shafts of the nails 10 at a substantially central location of the magazine 22 in a lengthwise direction of the nail as viewed in cross-section shown in FIG. 2.

The guide surface of the guide wall 25A has a length L and the protruding portion 25B has a thickness t in the lengthwise direction of the nail 10, and the length L is greater than the thickness t as shown in FIG. 2. Therefore, the guide surfaces can maintain accurate orientation of the nails 10 to thus provide smooth guiding to the nails 10. Accordingly damage to the nails 10 and to the guide surfaces can be avoided without excessive abrasion. In other words, wear resistance of the guiding surfaces can be improved.

Since the guide portions 25 protrude from both sides towards the nails 10, the nails 10 do not move violently within the magazine 22. Thus, a nail accommodation portion 30 is provided at the gap between the opposing guide walls 25A and at an area between the guide portions 25 and the guide groove 24. Further, since the guide portions 25 serve as reinforcing ribs for the magazine 22, bending strength of the magazine can be improved.

The nail feeder 23 is provided with a feeder spring 26 for pressing the nails 10 toward the nose 9. A biasing portion 27 including the pawl 27A and a pawl accommodation portion 27B is disposed within the feeder spring 26. The pawl accommodation portion 27B is adapted for housing the pawl 27A. A groove portion 22*e* is formed between the feeder fixing portion 22D and the guide portion 25 at the side of the feeder fixing portion 22D.

The main feeder unit 28 is provided to accommodate the feeder spring 26 and the pressuring portion 27. The main feeder unit 28 is provided with a convex portion 28A orienting substantially parallel to the axial direction of the nails 10. The convex portion 28A is slidably engaged with the groove portion 22*e*. Since a part of the biasing portion 27, (the part being the convex portion 28A) is in contact with the wall of the feeder fixing portion 22D and the guide portion 25, the nail feeder 23 including the main feeder unit 28 can slide reciprocally along the groove portion 22*e* without release from the magazine 22.

A holder portion 29 is provided in the main feeder unit 28 for holding the nail feeder 23 when the nail feeder 23 is pulled against the biasing force of the feeder spring 26.

The end section 21A on the handle 2A side of the magazine 22 (see FIG. 1) is formed to be narrower than the remaining part of the magazine device 21. In other words, the length of the end section 21A in the axial direction of the nails 10 is shorter than that of the remaining part such as a part in the vicinity of the fixing portion of the magazine 22 to the handle 2A. Compare vertical length of the magazine 21 between FIG. 2 and FIG. 3.

The nails 10 are inserted into the accommodation portion 30 from a distal end of the end section 21A. In this case, if the end section 21A is formed to be shorter than the length of the nails 10 (of course, the remaining portion is longer than the length of the nails in the axial direction of the nail), the nails cannot be inserted through the distal end. To avoid this problem, the gap 22*f* is formed in a location of the magazine 22 at a position opposite to the guide groove 24 and between the guide portions 25 and 25. Thus, even longer nails 10 can be inserted into the accommodation portion 30, since the shaft portions of the nails can travel through the gap 22*f*.

Figure 4:
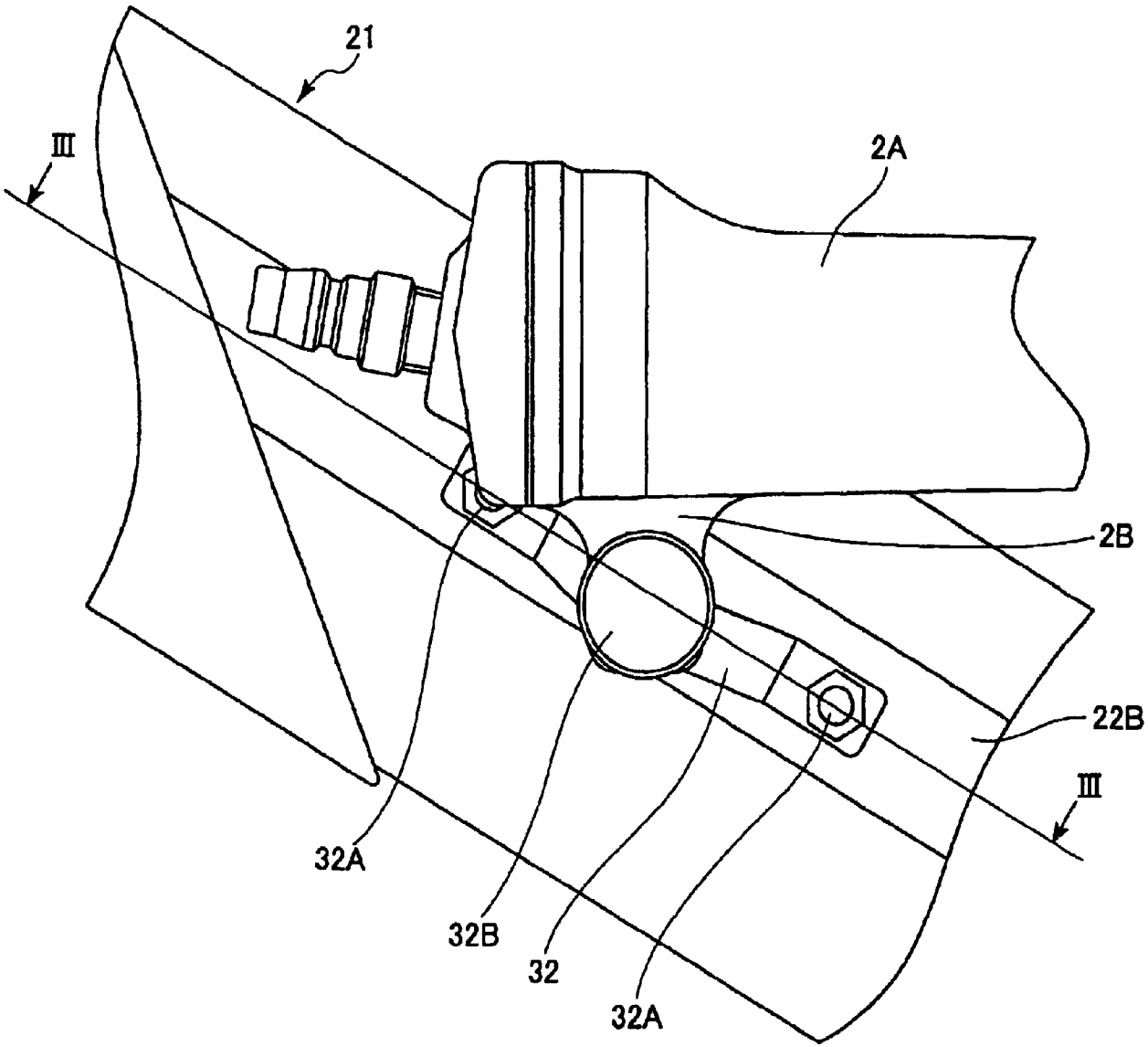
FIG. 4 is a view particularly showing an handle arm of the nail gun according to the embodiment.
Figure 5:
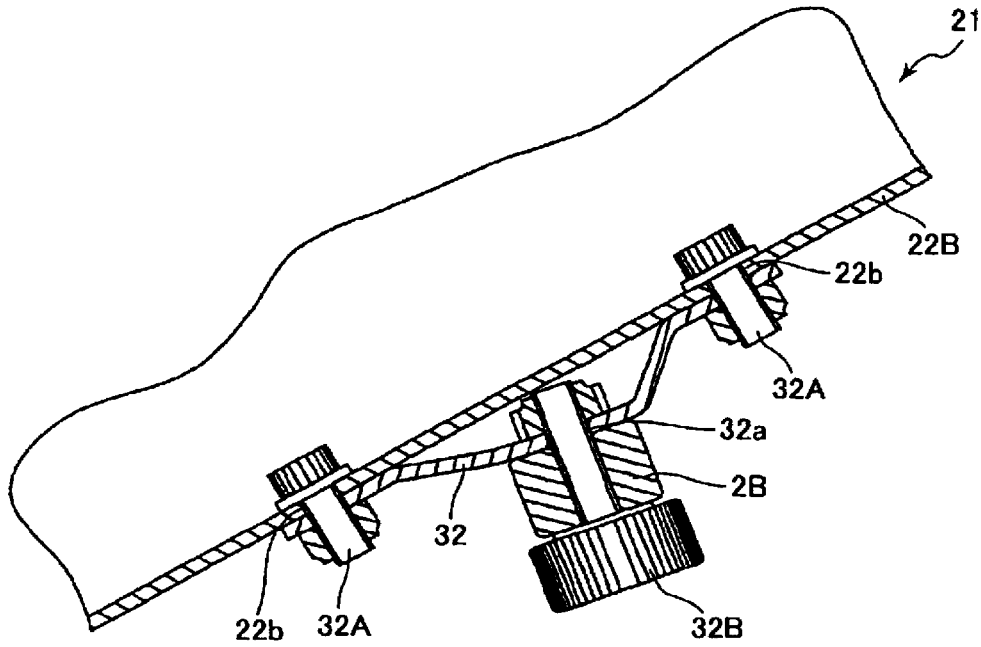
FIG. 5 is a cross-sectional view taken along the line III-III in FIG. 4.

As shown in FIGS. 4 and 5, a handle arm 32 is fixed to the flat surface portion 22B of the magazine 22 by a bolt 32A extending through the bolt hole 22*b* formed in the flat surface portion 22B. The bolt is fastened by a nut. Since the handle arm 32 has flat sections in abutment with the flat surface of the flat surface portion 22B, the handle arm 32 can be stably fixed to the magazine 22. The handle 2A has an attachment portion 2B. The handle arm 32 is formed with a fixing hole 32*a*, so that the handle arm 32 is fixed to the attachment portion 2B of the handle 2A by means of a bolt 32B extending through the fixing hole 32*a*.

Nail driving operation with the nail gun 1 will next be described. The user holds the handle 2A with one hand and the grasping section 31 of the magazine 22 with the other hand to stabilize the nail gun 1. In this state, the air hose (not shown) is connected to the nail gun 1 and compressed air fills the accumulator 3. During this time, the accumulator 3 and the main valve chamber 43 are in communication with each other through an air passage (not shown) and through the trigger valve section 15.

Since a part of the compressed air within the accumulator 3 flows into the main valve chamber 43, the main valve 42 is positioned at its bottom dead center by a downward load generated by the difference in pressure-receiving surface area between the lower outer peripheral surface of the main valve 42 and the upper end surface of the main valve 42, together with the biasing force of the main valve spring 44.

Locating the main valve 42 at bottom dead center brings the main valve 42 into contact with the upper end of the cylinder 5. Thus, the main valve is distant from the exhaust rubber 46 for opening the air passageway 45. This causes fluid communication between the space above the piston 4A and the atmosphere, bringing the space above the piston 4A to atmospheric pressure. Since the fluid communication between the space above the piston 4A and the accumulator 3 is blocked by the main valve 42, air cannot flow into the space above the piston 4A from the accumulator 3. Thus, the piston 4A is in a halted state at its top dead center.

From the state, the operation of pulling the trigger 12 and the operation of pressing the push lever 14 against the workpiece 48 to be nailed are both performed, to force the plunger 16 up to its top dead center. These operations shut off the fluid communication between the main valve chamber 43 and the accumulator 3 and also allows fluid communication between the main valve chamber 43 and the atmosphere through the air passage (not shown) and through the trigger valve section 15. Thus, the pressure in the main valve chamber 43 drops to substantially atmospheric pressure.

Bringing the main valve chamber 43 to substantially atmospheric pressure weakens the urging force that pushes the main valve 42 to its bottom dead center, so that the main valve 42 is moved to its top dead center. Thus, the main valve 42 is moved away from the upper end of the cylinder 5 to negate sealing therebetween.

Thus, the compressed air stored in the accumulator 3 flows into the cylinder space above the piston 4A through a gap between the main valve 42 and the upper end of the cylinder 5. The flow of compressed air into the cylinder space above the piston 4A increases the pressure applied to the lower surface of the main valve 42 to move the main valve 42 to its top dead center. Therefore, the main valve 42 is brought into contact with the exhaust rubber 46 to shut-off the air passageway 45. Consequently, a fluid communication between the cylinder space above the piston 4A and the atmosphere is shut-off, so that compressed air pressure is directly applied to the upper surface of the piston 4A to push the piston 4A to its bottom dead center.

During this time, a leading end of the nail array supplied from the magazine device 21 is positioned within the ejection aperture 9*a* in the nose 9 because of the biasing force applied by the nail feeder 23. Since the tip end 4C of the driver blade 4B is disposed at a reciprocally sliding location within the ejection aperture 9*a*, the movement of the piston 4A toward its bottom dead center also moves the tip end 4C within the ejection aperture 9*a* toward the workpiece 48 to be nailed. In this instance, the tip end 4C strikes the head of the nail 10 for driving the nail 10 into the workpiece 48.

Substantially simultaneously with the driving of the nail 10 into the workpiece 48, the air in the cylinder below the piston 4A flows into the return chamber 6 through the air passageway 6*a* and the check valve 7. When the piston 4A passes the air passageway 6*a*, a part of the compressed air in the cylinder above the piston 4A flows into the return chamber 6 through the air passageway 6*a*.

If trigger 12 is released or if the operation of pressing the push lever 14 against the workpiece 48 is stopped, the plunger 16 returns to its bottom dead center. As a result, the fluid communication between the main valve chamber 43 and the atmosphere is blocked and also the main valve chamber 43 and the accumulator 3 are brought into fluid communication with each other. Therefore, the compressed air of the accumulator 3 flows into the main valve chamber 43.

This causes a downward pressure load generated by the difference in pressure-receiving surface area between the lower outer peripheral surface of the main valve 42 and the upper end surface of the main valve 42, together with the biasing force of the main valve spring 44. Thus, the main valve 42 is moved toward its bottom dead center. The fluid communication between the accumulator 3 and the cylinder space above the piston 4A is shut-off when the main valve 42 is seated on the upper end of the cylinder 5. By the movement of the main valve 42, the main valve 42 is separated from the exhaust rubber 46, allowing fluid communication between the cylinder space above the piston 4A and the atmosphere.

Subsequently, the piston 4A moves abruptly toward its top dead center because of the pressure difference between the cylinder space below the piston 4A where compressed air is applied from the return chamber 6 and the cylinder space above the piston 4A where the atmospheric pressure is applied.

During this time, the tip end 4C of the driver blade 4B moves towards the upper dead center of the piston 4A within the ejection aperture 9*a* until the tip end 4C is located outside the ejection aperture 9*a* to provide a cavity within the ejection aperture 9*a*. Since the nail array in the magazine 22 is biased by the nail feeder 23 toward the ejection aperture 9*a*, a new nail 10 is supplied within the ejection aperture 9*a*.

By the movement of the piston 4A toward its top dead center, air in the cylinder space above the piston 4A is discharged into the atmosphere out of the exhaust vent 47 through the air passageway 45. Thus, the nail gun 1 returns to its initial state.

While the piston 4A is being driven by compressed air to drive the nail 10, acceleration due to impact occurs in the nail gun 1. This acceleration is also transmitted to the magazine 22 held by the user, and it is assumed that the accelerations will cause the magazine 22 to distort.

Figure 11:
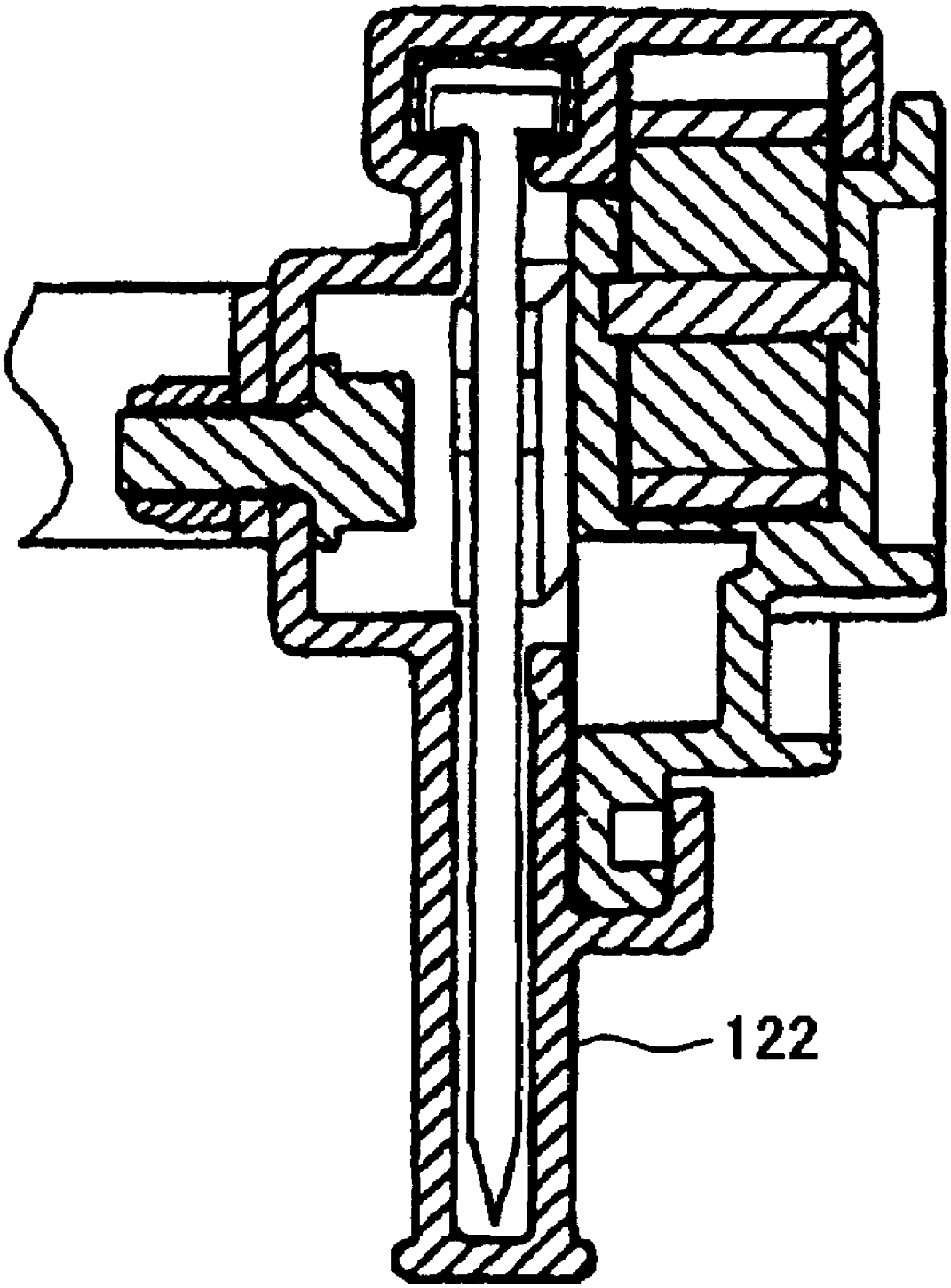
FIG. 11 is a cross-sectional view showing a magazine in a conventional nail gun.

A comparison is made between the magazine 122 of the conventional nail gun shown in FIG. 11 and the magazine 22 in accordance with this embodiment. As described above, the magazine 122 has a casing shaped in conformance with the shape of the nails while holding the nails.

The cross-sectional area and modulus of section of each of the magazine 122 and the magazine 22 are compared in an attempt to investigate each strength. More specifically, regarding the magazine 22, attention is drawn to a particular area including the expanding portion 22A and the part of the flat surface portion 22B contiguous therewith as shown in FIG. 6(*a*). Regarding the magazine 122 an area corresponding to the particular area is taken into attention as shown in FIG. 6(*b*). In FIGS. 6(*a*) and 6(*b*), a horizontal axis represents x-direction and a vertical-axis represents y-direction.

The cross-sectional areas of the magazine 22 and 122 were 249 $mm^2$ (A) and 303 $mm^2$ (B), respectively. This gives a ratio (A)/(B) of 0.82, so that the magazine 22 in accordance with this embodiment has a smaller cross-sectional area. Accordingly, it can be concluded that if the magazines 22 and 122 are designed to the same length and are made from the same material, the magazine 22 will be lighter in weight than the magazine 122.

Similarly, the modulus of section Z in the magazine 22 were Zx=2862 $mm^3$ and Zy=4163 $mm^3$ (A), whereas the modulus of section Z in the magazine 122 were Zx=792 $mm^3$ and Zy=2442 $mm^3$ (B). This gives ratios of (A)Zx/(B)Zx of 3.61 and (A)Zy/(B)Zy of 1.45. This clearly shows that the modulus of section of magazine 22 is greater than that of the magazine 122. Generally, the bending strength and distorsional strength of a component are proportional to the modulus of section thereof. Therefore, it can be concluded that the magazine 22 in accordance with this embodiment provides mechanical strength and rigidity higher than those of the magazine 122.

Thus by employing the magazine device 21 having the magazine 22 in accordance with this embodiment, a wall thickness of the magazine can be reduced and the nail gun can be made lighter than the conventional nail gun while maintaining a high rigidity, so that the magazine device 21 is resistant to distortion even when accelerations due to impact is imparted to the nail gun 1. Consequently, the nails 10 are supplied to the ejection aperture 9*a* in a stabilized fashion.

Figure 7:
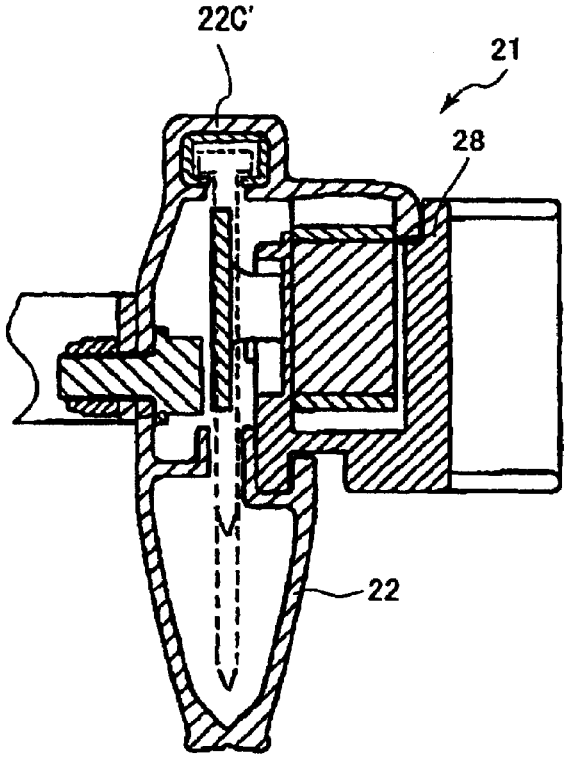
FIG. 7 is a cross-sectional view of a magazine device in a fastener driving tool according to a first modification to the embodiment.

As a first modification to the above-described embodiment, as shown in FIG. 7, a periphery of a guide groove portion 22C' could be formed of straight lines. Such a shape can reduce the weight to approximately 75% of that of the magazine 122 in accordance with the conventional example.

Figure 8:
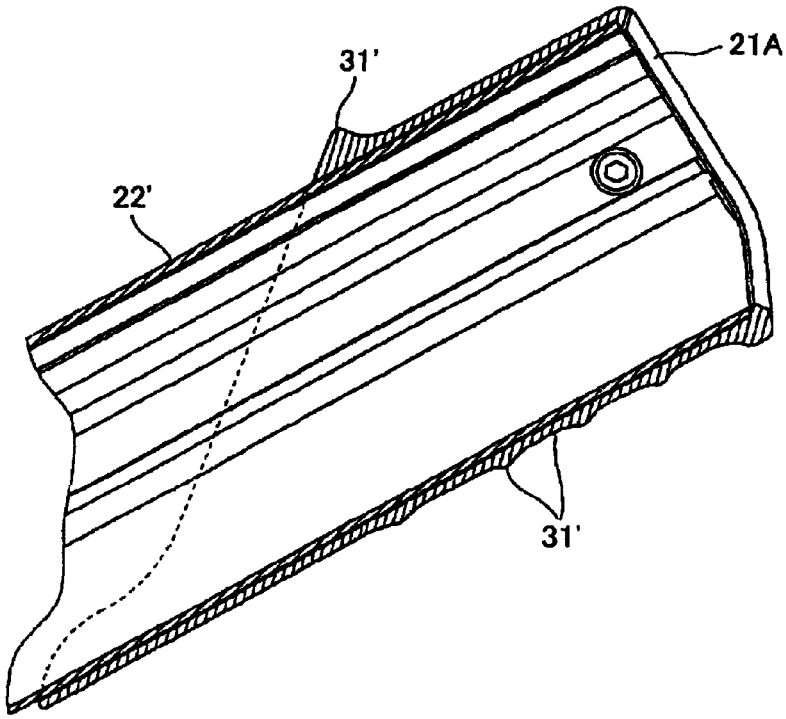
FIG. 8 is a partial view of a magazine device in a fastener driving tool according to a second modification to the embodiment.

As a second modification to the above-described embodiment, as shown in FIG. 8, if the nail gun 1 is smaller and also the nails 10 used therein are also smaller, a periphery of a grasping section 31' of the magazine 22' could be formed to be the same shape as the remaining part of the magazine 22'. This enables the formation of the outer shape of the magazine 22' by simple extrusion method without adversely affecting the holding capability of the nail gun. Thus, manufacturing costs and time can be reduced.

Figure 9:
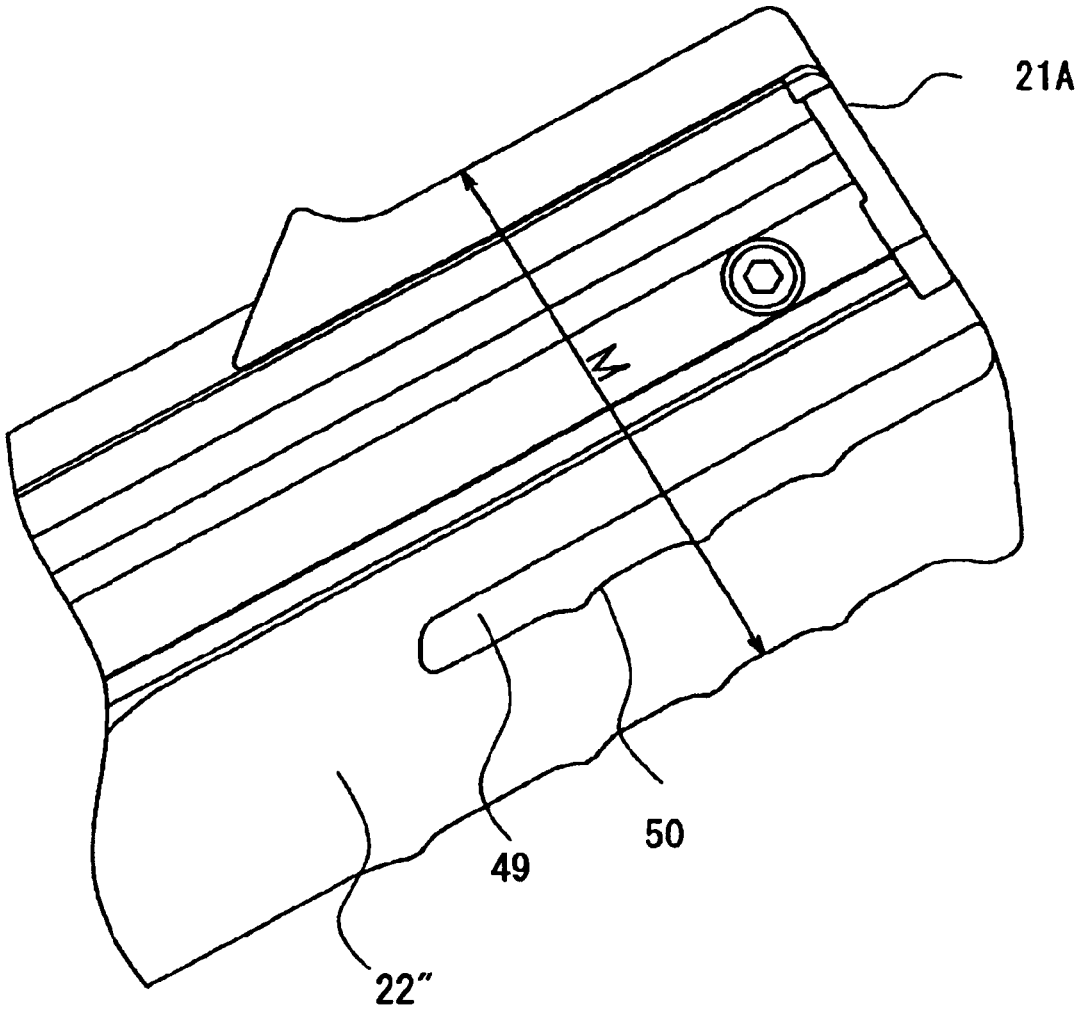
FIG. 9 is a partial view of a magazine device in a fastener driving tool according to a third modification to the embodiment.
Figure 10:
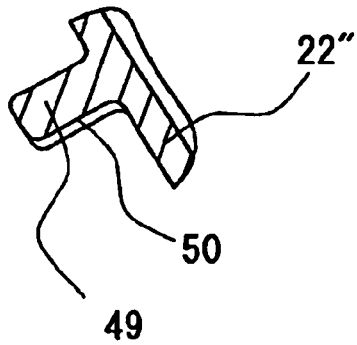
FIG. 10 is a cross-sectional view of an end section of the third modification.

In some circumstances, the outer periphery of the grasping section would have to be made larger, if the nails 10 used are large or to ensure the strength of the magazine. In such a case, as shown in FIGS. 9 and 10, a rib 49 could be provided on a side surface of the magazine 22". This enables a finger to engage with the rib 49, even when the span shown at M in FIG. 9 is difficult to hold by the fingers, making the magazine 22" easy to hold. Further, the rib 49 is formed with finger-shaped indentations 50 at a bottom surface of the rib 49. This facilitates holding of the magazine 22".

While the invention has been described in detail and with reference to specific embodiment thereof, it would be apparent to those skilled in the art that various changes and modifications may be made therein without departing from the spirit and scope of the invention.

For example, although compressed air is used as the motive force in the fastener driving tool according to the above-described embodiment, the present invention is not limited thereto, but can be applied to magazine devices to be incorporated into a combustion powered fastener driving tool, or a motor powered fastener driving tool.

What is claimed is:

1. A fastener driving tool comprising:

a frame;

a nose portion extending outward from the frame for contacting a workpiece, and formed with an ejection passage;

a driver blade reciprocally movable within the ejection passage;

a handle portion extending outward from the frame and providing a grasping portion; and a magazine device bridging between the nose portion and the handle portion for supplying fasteners to a position of the ejection passage, the magazine device comprising:

a magazine having one end and another end in a moving direction of the driver blade, and defining an accommodation portion having two opposing walls for accommodating therein a fastener array, each fastener having a shaft with a sharp-end and a head connected to the shaft, a plurality of fasteners being directed in parallel with the moving direction of the driver blade in the magazine and being positioned side by side to form the fastener array, the accommodation portion comprising an expanding portion having a width delimited between the two opposing walls in a direction perpendicular to the shaft of the fastener and to the fastener array, the width being gradually increased from the one end close to the sharp end of the fastener toward the another end close to the head of the fastener;

a nail feeder disposed in the magazine for urging the fastener array toward the ejection passage; and wherein the one end of the magazine close to the sharp end of the fastener is a closed end formed by joining of the two opposing walls of the accommodation portion, the width of the accommodation portion being continuously increased from the closed end to at least a portion of the opposing walls accommodating the shaft of the fastener therebetween.

2. The fastener driving tool as claimed in claim 1, wherein the expanding portion has an arcuate outer surface as viewed in cross-section extending in a direction perpendicular to the shaft of the fastener and to the fastener array.

3. The fastener driving tool as claimed in claim 1, wherein the magazine device further comprises a guide portion protruding from the magazine to a position contactable with the fastener for supporting the fasteners in the magazine.

4. The fastener driving tool as claimed in claim 3, wherein the guide portion comprises:

a protruding portion protruding from the magazine in a direction perpendicular to the shaft of the fastener and to the fastener array; and a guide wall coupled to the protruding portion and having a guiding surface in contact with the fasteners, the guiding surface having a length in the axial direction of the fastener, and the protruding portion having a thickness in the axial direction of the fastener, the length being greater than the thickness.

5. The fastener driving tool as claimed in claim 1, wherein the magazine extends in a direction of the fastener array, and has one end portion near an end of the handle portion furthest from the frame and a remaining portion, the one end portion having an outer cross-sectional contour smaller than that of the remaining portion.

6. The fastener driving tool as claimed in claim 5, wherein the magazine further comprises substantially finger-shaped indentations provided on an outer periphery of the one end portion.

7. The fastener driving tool as claimed in claim 1, wherein the magazine extends in a direction of the fastener array, and has one end portion near the handle portion furthest from the frame, the magazine further comprising a rib protruding from the one end portion.

8. The fastener driving tool as claimed in claim 1, wherein the magazine has an outer flat surface; and the fastener driving tool further comprising a handle arm connected to the handle portion and having a flat region in surface contact with the outer flat surface of the magazine.

9. The fastener driving tool as claimed in claim 1, further comprising:

a cylinder disposed in the frame; and a piston reciprocally slidably disposed in the cylinder, the driver blade being connected to the piston.

10. A magazine device comprising:

a magazine extending in a first direction and defining an accommodation portion having opposing walls for accommodating therein a fastener array, each fastener having a shaft with a sharp-end and a head connected to the shaft, a plurality of fasteners being directed in a second direction perpendicular to the first direction and positioned side by side to form the fastener array extending in the first direction, the magazine having one end and another end in the second direction, the one end being close to the sharp end of the fastener and the another end being close to the head of the fastener, the accommodation portion comprising an expanding portion having a width delimited between the two opposing walls in a third direction perpendicular to the first direction and to the second direction, the width being gradually increased from the one end toward the another end;

a nail feeder disposed in the magazine for urging the fastener array in the first direction; and wherein the one end of the magazine close to the sharp end of the fastener is a closed end formed by joining of the two opposing walls of the accommodation portion, the width of the accommodation portion being continuously increased from the closed end to at least a portion of the opposing walls accommodating the shaft of the fastener therebetween.

11. The magazine device as claimed in claim 10, wherein the expanding portion has an arcuate outer surface as viewed in cross-section extending in the second and third directions.

12. The magazine device as claimed in claim 10, further comprising a guide portion protruding from the magazine in the third direction to a position contactable with the fastener for supporting the fasteners in the magazine.

13. The magazine as claimed in claim 12, wherein the guide portion comprises:

a protruding portion protruding from the magazine in the third direction; and a guide wall coupled to the protruding portion and having a guiding surface in contact with the fastener, the guiding surface having a length in the second direction, and the protruding portion having a thickness in the second direction, the length being greater than the thickness.

14. The magazine device as claimed in claim 10, wherein the magazine has one end portion through which fasteners are inserted, and a remaining portion, the one end portion having an outer cross-sectional contour smaller than that of the remaining portion.

15. The magazine device as claimed in claim 14, wherein the magazine further comprises substantially finger-shaped indentations provided on an outer periphery of the one end portion.

16. The magazine device as claimed in claim 10, wherein the magazine has one end portion through which fasteners are inserted, and the magazine further comprises a rib protruding from the one end portion.

17. A fastener driving tool comprising:

a frame;

a nose portion extending outwardly from the frame for contacting a workpiece, and formed with an ejection passage;

a driver blade reciprocally movable within the ejection passage;

a handle portion extending outwardly from the frame and providing a grasping portion; and a magazine device bridging between the nose portion and the handle portion for supplying fasteners to a position of the ejection passage;

wherein the magazine device includes a magazine for accommodating a fastener array and a nail feeder for urging the fastener array toward the ejection passage; and wherein the magazine includes an expanding portion having two opposing walls which are configured into an arcuate shape and delimit a width between the opposing walls which continuously increases from a closed end where the opposing walls are joined to at least a portion of the opposing walls accommodating a shaft of a fastener therebetween, a flat surface portion having a flat surface shape and being contiguous with the expanding portion, a feeder fixing portion contiguous with the expanding portion at a location opposite to the flat surface portion, a guide groove portion defining therein a guide groove and extending between the flat surface portion and the feeder fixing portion, and first and second guide portions positioned in confrontation to each other, the first guide portion protruding toward a fastener from a boundary between the expanding portion and the flat surface portion, and the second guide portion protruding toward the fastener from a boundary between the expanding portion and the feeder fixing portion.

18. The fastener driving tool as claimed in claim 17, wherein each of the first and second guide portions includes a protruding portion that protrudes from the magazine toward the fastener, and a guide wall connected with the protruding portion and extending in parallel with the fastener toward a head of the fastener.

* * * * *